US006256944B1

(12) United States Patent
Lyzinski et al.

(10) Patent No.: US 6,256,944 B1
(45) Date of Patent: Jul. 10, 2001

(54) METHOD AND SYSTEM FOR KEEPING WATER FROM ENTERING DISPENSER CONTAINMENT SUMPS

(75) Inventors: David Lyzinski, Wheaton; Michael Butkovich, Aurora; Albert Kovach, Sugar Lane; Charles M. Daul, Libertyville, all of IL (US)

(73) Assignee: BP Amoco Corporation, Chicago, IL (US)

( * ) Notice: Subject to any disclaimer, the term of this patent is extended or adjusted under 35 U.S.C. 154(b) by 0 days.

(21) Appl. No.: 09/418,163

(22) Filed: Oct. 13, 1999

Related U.S. Application Data

(60) Provisional application No. 60/104,927, filed on Oct. 20, 1998.

(51) Int. Cl.[7] ..... E02D 19/00

(52) U.S. Cl. ..... 52/169.14; 52/741.4; 405/52

(58) Field of Search ..... 52/169.14, 741.3, 52/741.4, 741.12, 745.06, 3; 277/322, 326, 935; 141/1, 86; 137/312; 405/52, 55, 53; 220/530, 565, 573; 73/49.2, 40.5 R

(56) References Cited

U.S. PATENT DOCUMENTS

| | | | | |
|---|---|---|---|---|
| D. 296,462 | | 6/1988 | Hartman et al. . | |
| 3,734,336 | * | 5/1973 | Rankow et al. | 220/516 |
| 4,615,362 | | 10/1986 | Hartman et al. | 141/86 |
| 4,648,523 | | 3/1987 | Strock | 220/530 |
| 4,673,034 | * | 6/1987 | Hansen | 277/322 X |
| 4,763,805 | | 8/1988 | Strock | 220/723 |
| 4,813,269 | | 3/1989 | Brown et al. | 73/49.2 |
| 4,813,277 | | 3/1989 | Miller et al. | 73/49.2 |
| 4,813,284 | | 3/1989 | Miller et al. | 73/49.2 |
| 4,813,285 | | 3/1989 | Brown et al. | 73/49.2 |
| 4,968,179 | * | 11/1990 | Frahm | 405/52 X |
| 5,192,430 | * | 3/1993 | Mohr | 210/172 |
| 5,954,103 | * | 9/1999 | Smith | 141/86 |
| 6,050,050 | * | 4/2000 | Daul et al. | 52/741.12 |
| 6,074,131 | * | 6/2000 | Daul et al. | 405/55 |

* cited by examiner

*Primary Examiner*—Peter M. Cuomo
*Assistant Examiner*—James O. Hansen
(74) *Attorney, Agent, or Firm*—Ekkehard Schoettle

(57) ABSTRACT

A method and system for preventing water entering a dispenser from collecting in the containment pan. This method utilizes a shield or barrier placed inside the dispenser above the containment pan. The material used to form the barrier is insoluble in water but soluble in the hydrocarbons typically found in a dispensing system.

22 Claims, 3 Drawing Sheets

METHOD AND SYSTEM FOR KEEPING WATER FROM ENTERING DISPENSER CONTAINMENT SUMPS

RELATED APPLICATIONS

This application claims the benefit of U.S. Provisional Application No. 60/104,927 filed Oct. 20, 1998, which is hereby incorporated by reference in its entirety.

FIELD OF INVENTION

This invention relates to water resistant covers for a fuel dispenser containment sump, and more particularly to a system for covering such a dispenser containment sump that selectively prevents water from entering the sump but allows hydrocarbons to enter the sump.

BACKGROUND OF THE INVENTION

It is highly desirable to have containment sumps or pans installed under the fuel dispensers at a service station to prevent accidental contamination of the soil. These dispenser "pans" can be installed during construction or retrofitted to existing operating stations. Use of a dispenser pan is very effective for containing accidental spills or leaks that may occur inside the dispenser.

A negative side effect is that the dispenser pans are also very effective containment for any water that enters the pan from the outside the dispenser, such as occurs during rain storms or dispenser cleaning. Since containment sumps that have had prior contact with gasoline is the norm, any water collected in these sumps represents a hazardous waste and is very costly to remove.

Attempts by the dispenser manufacturers have been made to make the dispenser itself watertight, thus preventing ingress of water into the containment pan. While these systems are somewhat successful, the cost of such systems is very high. It is desirable to have a low cost solution to the problem.

SUMMARY OF THE INVENTION

The primary invention, as illustrated in FIGS. 1 through 4, comprises a foam plastic shield, such as a foam polystyrene shield, that deflects water entering the dispenser from entering the containment pan. The foam polystyrene, or other suitable water impermeable barrier, sheds the water but allows any hydrocarbon fuel that contacts the water barrier to rapidly dissolve the barrier resulting in the hydrocarbon fuel entering and being contained by the containment pan.

Several variations of this idea are also disclosed in FIGS. 5 & 6. One variation shown in FIG. 5, allows for an impermeable barrier to be formed across the containment pan and a gasoline or hydrocarbon soluble plug to be placed through a hole in the barrier. This barrier is designed to contain a minimum volume of liquid such that water entering the dispenser will run off and be diverted from the containment sump. Should any hydrocarbon drip inside the dispenser, it will rapidly dissolve the plug and enter the containment sump.

Another variation is shown in FIG. 6, where a water impermeable barrier is formed across the top of the sump to prevent water from entering. This barrier would be hydrocarbon soluble and allow any hydrocarbon contacting it to rapidly dissolve and enter the containment pan.

DETAILED DESCRIPTION OF THE INVENTION

A detailed description of the preferred embodiments of the invention are described as follows.

Figure 1:
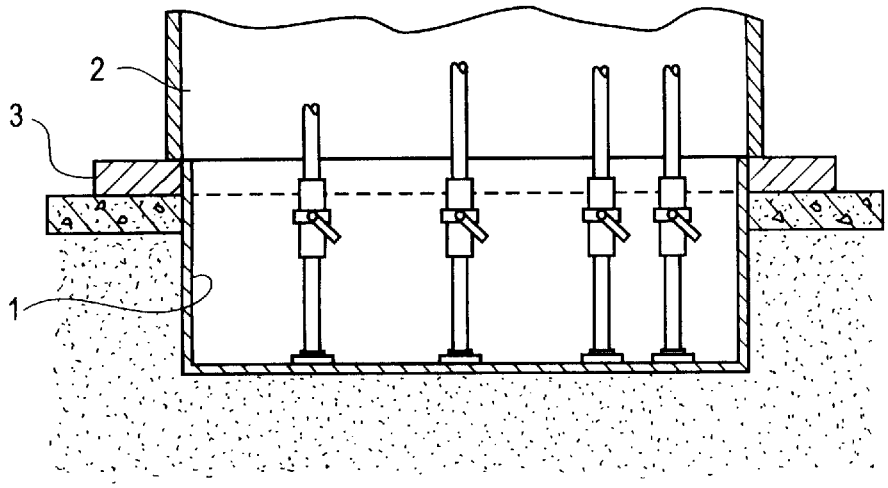
FIG. 1 PRIOR ART
FIG. 1 shows a typical dispenser containment pan.

Referring to the drawings, where the characters refer to corresponding parts throughout the views, FIG. 1 shows a typical dispenser containment pan. A typical, commercially available containment pan (1) may be constructed of any suitable material such as fibreglass reinforced plastic or polyethylene. The containment pan (1) is positioned below the dispenser assembly (2) and is typically fastened to the dispenser island (3).

Figure 2:
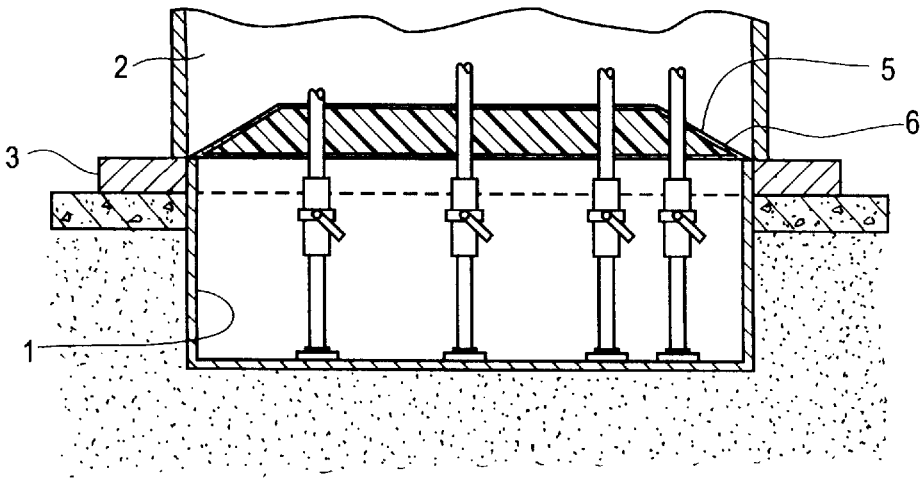
FIG. 2 shows a typical dispenser containment pan with a foam polystyrene water shield installed according to the invention.

FIG. 2 shows a typical dispenser containment pan with a foam polystyrene water shield installed according to the invention. A foam polystyrene shield (4) is positioned inside the dispenser and over the containment pan in such a way that water entering the dispenser would be deflected by the foam polystyrene "roof". The seams of the roof (5) are sealed with tape or caulking. Similarly, the edges at the base of the "roof" (6) are sealed with tape or caulking.

Figure 3:
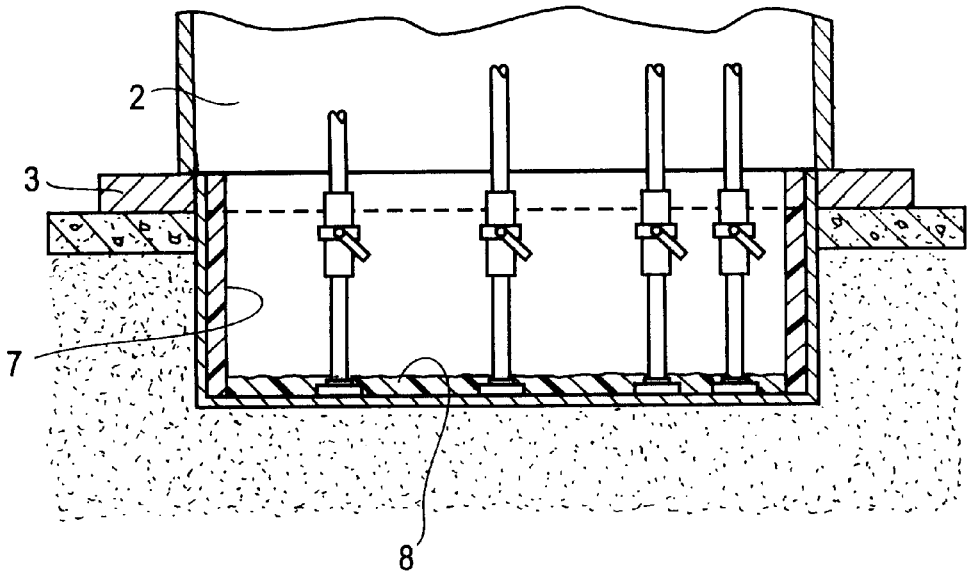
FIG. 3 PRIOR ART
FIG. 3 shows a typical dispenser with upgraded sidewalls and floor.

FIG. 3 shows a typical dispenser with upgraded sidewalls and floor. This is an illustration of a containment pan that has been installed under an existing dispenser which did not have a containment pan. Polymeric material (7) is used to form the sidewalls. A pourable, self-leveling polymer (8) is used to form the floor of the containment pan. This upgrade has been described fully in a U.S. Pat. application Ser. No. 09/000,706 titled "Form In-Place Dispenser Containment" dated Dec. 30, 1997 now U.S. Pat. No. 6,074,131.

Figure 4:
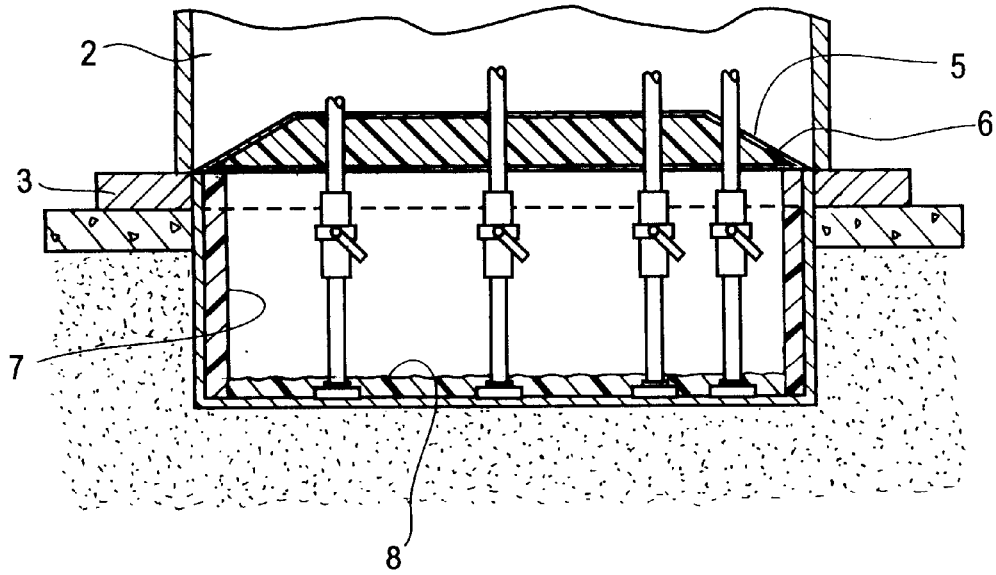
FIG. 4 shows a typical dispenser with upgraded sidewalls and floor and a foam polystyrene water shield installed according to the invention.

FIG. 4 shows a typical dispenser with upgraded sidewalls and floor with a foam polystyrene water shield installed according to the invention. A foam polystyrene shield (4) is positioned inside the dispenser and over the upgraded containment pan in such a way that water entering the dispenser would be deflected by the foam polystyrene "roof". The seams of the roof (5) are sealed with tape or caulking. Similarly, the edges at the base of the "roof" (6) are sealed with tape or caulking.

Figure 5:
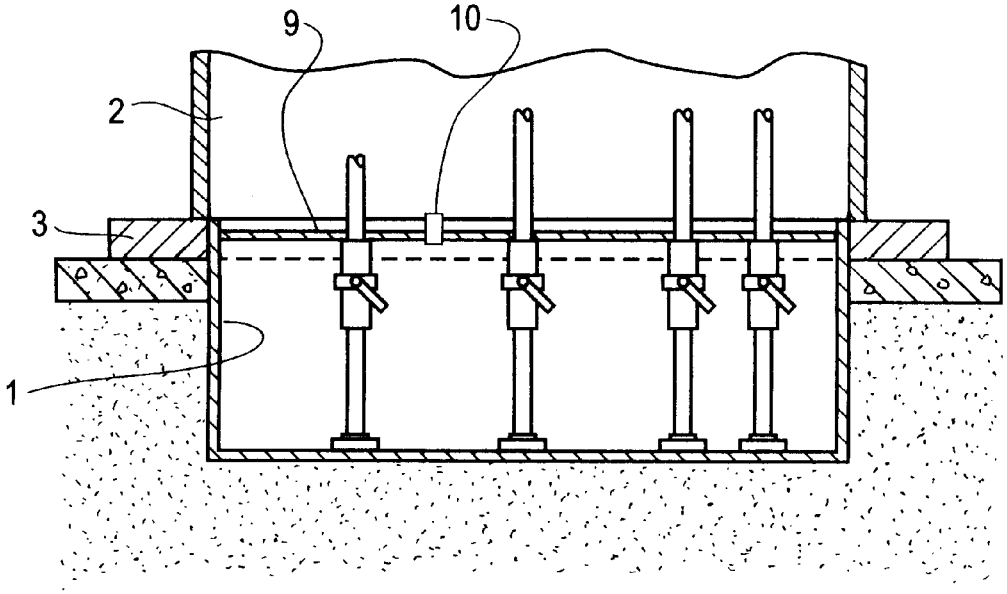
FIG. 5 shows a typical dispenser containment pan with impermeable barrier and a foam polystyrene plug installed according to the invention.

FIG. 5 shows a typical dispenser containment pan with an impermeable barrier and a foam polystyrene plug installed according to the invention. This figure illustrates an impermeable barrier (9) formed across the containment pan (1). A hydrocarbon soluble plug (10) is placed through a hole in the barrier. This barrier is designed to contain a minimum volume of liquid such that water entering the dispenser will run off and be diverted from the containment sump.

Figure 6:
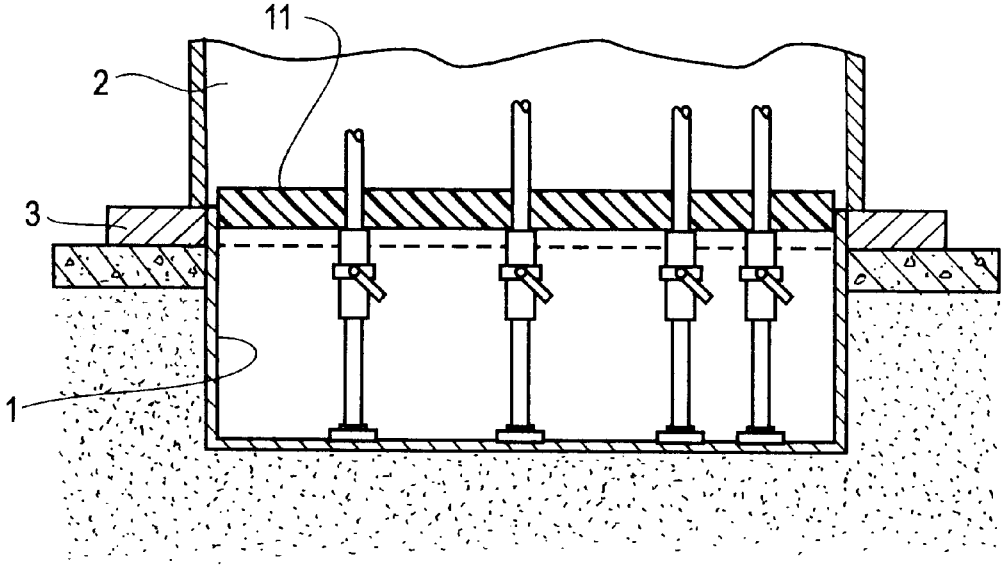
FIG. 6 shows a typical dispenser containment pan with a foam polystyrene barrier installed according to the invention.

FIG. 6 shows a typical dispenser containment pan with a foam polystyrene barrier installed according to the invention. This figure illustrates a water impermeable barrier (11) formed across the top of the containment pan (1).

The preferred embodiment is to install a foam polystyrene shield or "roof" inside the dispenser and above the containment pan that deflects water entering the dispenser thus keeping the water from entering the containment pan. The material used in the most preferred embodiment is foam polystyrene because foam polystyrene readily dissolves in gasoline and other hydrocarbons. Another preferred embodiment is any other suitable water impermeable barrier which sheds the water but allows any gasoline or hydrocarbon that contacts the barrier to rapidly dissolve the barrier. This results in gasoline or other hydrocarbon being contained by the containment pan. Another preferred embodiment would be a barrier which sheds water but allows gasoline to permeate but not dissolve or destroy the barrier. For example, this barrier could be constructed of a fabric that is hydrophobic but allow hydrocarbons to pass through.

Another preferred embodiment allows for a water impermeable barrier to be formed across the top of the sump to prevent water from entering. This barrier is designed to effectively seal the containment pan at the top. This barrier would be hydrocarbon soluble and allow any hydrocarbon contacting it to rapidly dissolve and enter the containment pan. The material of the most preferred embodiment would be foam polystyrene.

Another preferred embodiment allows for a hydrocarbon and water impermeable barrier to be formed across the containment pan and a gasoline or hydrocarbon soluble plug to be placed through a hole in the barrier. This barrier is designed to effectively seal the containment pan at the top. A minimum volume of water entering the dispenser will remain on top of this barrier with the rest allowed to run off and be diverted from the containment sump. Any hydrocarbon that might drip or leak from inside the dispenser will rapidly dissolve the plug and enter the containment sump. The material of this embodiment would be an insoluble foam, such as polyurethane foam, or a form in place rubber material, such as Morton Thiokol, RLP-2078. The barrier can be formed by filling the containment pan to the desired height of the barrier with water, then floating the foaming material or rubber compounding materials on the water until these materials harden. After hardening, the water is pumped from the containment pan through the hole which is plugged with the gasoline soluble material. The water is then properly disposed.

While only certain embodiments have been set forth herein, alternative embodiments and various modifications will be apparent from the above description to those skilled in the art. These alternatives are considered equivalents and within the spirit and scope of the invention.

What is claimed is:

1. A fuel dispenser system for use in a service station, comprising:

a hydrocarbon fuel dispenser for dispensing gasoline or other liquid hydrocarbon fuel;

a hydrocarbon containment sump providing a dispenser containment pan positioned below said hydrocarbon fuel dispenser for containing some hydrocarbon fuel from the hydrocarbon fuel dispenser and for helping to prevent leakage and spillage of hydrocarbon fuel from the hydrocarbon fuel dispenser into the soil or ground around said hydrocarbon fuel dispenser; and a water-impermeable barrier for substantially protecting and covering said hydrocarbon containment sump to substantially prevent water from passing into said hydrocarbon containment sump, and said water-impermeable barrier comprising a hydrocarbon-soluble portion for allowing gasoline and other liquid hydrocarbon fuels to pass into said hydrocarbon containment sump.

2. A fuel dispenser system in accordance with claim 1 wherein said water-impermeable barrier comprises a cover.

3. A fuel dispenser system in accordance with claim 1 wherein said water-impermeable barrier comprises a shield.

4. A fuel dispenser system in accordance with claim 1 wherein said water-impermeable barrier comprises a roof.

5. A fuel dispenser system in accordance with claim 1 wherein said water-impermeable barrier comprises a hydrophobic fabric barrier.

6. A fuel dispenser system in accordance with claim 1 wherein said water-impermeable barrier is sealed with caulking or tape.

7. A fuel dispenser system in accordance with claim 1 wherein said hydrocarbon-soluble portion comprises foam plastic.

8. A fuel dispenser system in accordance with claim 1 wherein said hydrocarbon-soluble portion comprises foam polystyrene.

9. A method of waterproofing a hydrocarbon containment sump for a hydrocarbon fuel dispenser, comprising the steps of:

selecting a hydrocarbon-soluble material;

shaping said material to form a cover for said containment sump; and sealing said containment sump with said cover.

10. A method in accordance with claim 9 including allowing gasoline and other liquid hydrocarbons to pass through said cover into said containment sump.

11. A method in accordance with claim 10 including substantially preventing water from entering said containment sump through said cover.

12. A method in accordance with claim 9 wherein said sealing comprises caulking.

13. A method in accordance with claim 9 wherein said scaling comprises taping.

14. A method in accordance with claim 9 wherein said containment sump comprises a containment pan.

15. A method in accordance with claim 14 wherein said containment pan comprises a retrofitted dispenser containment pan which has been retrofitted for a dispenser in an existing service station.

16. A method in accordance with claim 14 wherein said hydrocarbon-soluble material comprises a water impermeable barrier.

17. A method in accordance with claim 16 wherein said water-impermeable barrier comprises a hydrocarbon soluble plug.

18. A method in accordance with claim 10 including forming said water-impermeable barrier by:

filling the containment pan with water to a desired height;

floating material comprising the water-impermeable barrier on the water;

hardening the floated material comprising the water-impermeable barrier; and pumping or withdrawing the water from the containment pan.

19. A method in accordance with claim 9 wherein said cover comprises a hydrophobic fabric barrier.

20. A method in accordance with claim 9 wherein said cover comprises a roof.

21. A method in accordance with claim 9 wherein said cover comprises a foam plastic shield.

22. A method in accordance with claim 9 wherein said hydrocarbon-soluble material comprises polystyrene foam.

* * * * *